US009283790B2

(12) United States Patent
Tanaka

(10) Patent No.: US 9,283,790 B2
(45) Date of Patent: Mar. 15, 2016

(54) LIQUID EJECTING METHOD AND LIQUID EJECTING APPARATUS

(71) Applicant: SEIKO EPSON CORPORATION, Tokyo (JP)

(72) Inventor: Takeshi Tanaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/462,980

(22) Filed: Aug. 19, 2014

(65) Prior Publication Data

US 2015/0054881 A1 Feb. 26, 2015

(30) Foreign Application Priority Data

Aug. 20, 2013 (JP) ..... 2013-170418

(51) Int. Cl.

*B41J 29/38* (2006.01)
*B41J 2/195* (2006.01)
*B41J 29/393* (2006.01)
*B41J 2/175* (2006.01)

(52) U.S. Cl.

CPC ..... *B41J 29/38* (2013.01); *B41J 2002/17569* (2013.01)

(58) Field of Classification Search

CPC ..... B41J 2/17566; B41J 2002/17589; B41J 2002/17569; B41J 29/38
USPC ..... 347/6, 7, 9, 14, 19
See application file for complete search history.

(56) References Cited

U.S. PATENT DOCUMENTS

| | | | | |
|---|---|---|---|---|
| 6,086,180 | A | 7/2000 | Sugimoto et al. | |
| 6,234,597 | B1 | 5/2001 | Suzuki et al. | |
| 2010/0026741 | A1 * | 2/2010 | Gold et al. | 347/7 |
| 2012/0105530 | A1 * | 5/2012 | Munakata | B41J 2/17566 347/14 |

FOREIGN PATENT DOCUMENTS

| | | |
|---|---|---|
| JP | 07-052409 | 2/1995 |
| JP | 09-187963 | 7/1997 |
| JP | 11-005300 | 1/1999 |
| JP | 11-334104 | 12/1999 |
| JP | 2004-202933 | 7/2004 |

* cited by examiner

*Primary Examiner* — Jannelle M Lebron
(74) *Attorney, Agent, or Firm* — Workman Nydegger

(57) ABSTRACT

A liquid ejecting method of a liquid ejecting apparatus that ejects a liquid onto a target on the basis of acquired conditions, includes acquiring a residual amount of liquid that is useable, estimating a use amount of liquid that is used in ejection of liquid using a set use amount of liquid per single target quantity that is set in advance with respect to a size of a target that is included in the acquired conditions, and performing a warning that is related to the residual amount of liquid before ejecting the liquid onto the target that is used in a case in which the residual amount of liquid after liquid ejection, which is estimated on the basis of the residual amount of liquid and the use amount of liquid, is smaller than a threshold value.

11 Claims, 9 Drawing Sheets

RD1

| PAPER SHEET SIZE | PAPER SHEET TYPE | INK USE AMOUNT/SHEET |
|---|---|---|
| A3 SIZE | SPECIALTY PAPER | QA3 |

FIG. 10

RD2

| PAPER SHEET SIZE | PAPER SHEET TYPE | PRINTING MODE | INK USE AMOUNT/SHEET |
|---|---|---|---|
| A3 SIZE | SPECIALTY PAPER | HIGH IMAGE QUALITY MODE | QA3 |

FIG. 11

RD3

| PAPER SHEET SIZE | PAPER SHEET TYPE | INK USE AMOUNT/SHEET |
|---|---|---|
| A3 SIZE | SPECIALTY PAPER | QA3S |
| | NORMAL PAPER | QA3N |
| A4 SIZE | SPECIALTY PAPER | QA4S |
| | NORMAL PAPER | QA4N |
| ⋮ | ⋮ | ⋮ |
| POSTCARD | SPECIALTY PAPER | QHS |
| | NORMAL PAPER | QHN |

LIQUID EJECTING METHOD AND LIQUID EJECTING APPARATUS

BACKGROUND

1. Technical Field

The present invention relates to a liquid ejecting method and a liquid ejecting apparatus that has a liquid ejecting unit that is capable of ejecting a liquid such as ink.

2. Related Art

In a liquid ejecting apparatus such as an ink jet printer for example, an image or the like is printed on a target such as a paper sheet by ejecting ink as an example of a liquid from nozzles of a liquid ejecting head (an example of a liquid ejecting unit). In addition, liquid ejecting apparatuses of this kind are provided with ink cartridges that store ink, and are configured so that printing is interrupted and ink cartridge exchange is prompted when a residual amount of ink that is inside the ink cartridges reaches ink depletion. For example, when printing is interrupted, since printing is initiated with an ink that had temporarily dried up after ink cartridge exchange and this causes defects such as streaks being formed at the boundaries thereof, it is preferable to know beforehand whether or not ink depletion that causes an interruption in printing will occur in the middle of printing.

JP-A-11-5300 discloses a recording device that performs a warning of ink depletion beforehand, prior to the initiation of printing. In such a recording device, the number of ink droplets that have been emitted in printing processes and the number of egested ink droplets due to cleaning actions and flashing actions are counted by a dot counter for each color, and the obtained emitted dot number is delivered to residual ink amount detection means of a recording material exhaustion warning device. The recording material exhaustion warning device calculates a residual amount of ink for each color on the basis of a received emitted dot number. In addition, a required amount of ink is calculated on the basis of count values of the dot numbers of a concentrated bitmap and a pale bitmap after a halftone process by a halftone module or the sum of gradation values of individual gradation bit image data for each color after color correction processing using a color correction module. A warning message or the like is displayed on a warning unit as a result of the residual amount of ink and the required amount of ink being compared by ink consumption amount determination means.

However, in the recording device disclosed in JP-A-11-5300, since the required amount of ink is calculated on the basis of binary data of concentrated and pale after a halftone process or the sum of gradation values of individual gradation bit image data for each color after color correction processing using a color correction module, it is possible to calculate a comparatively accurate required amount of ink, but the calculation time is long. Therefore, even in a case in which ink depletion does not occur in the middle of printing and thus, a warning is not necessary, there is a problem in that it takes time for the device to initiate a printing action after a user gives an instruction to print. Additionally, this is not limited to ink jet printers, and the same problem also applies to liquid ejecting apparatuses that eject liquids other than ink.

SUMMARY

An advantage of some aspects of the invention is to provide a liquid ejecting method and a liquid ejecting apparatus in which a waiting time due to a liquid run-out prediction process from when a user gives an instruction to eject liquid to when a liquid ejecting action is initiated is comparatively short in a case in which a warning is unnecessary. In addition, another advantage of some aspects of the invention is to provide a liquid ejecting method and a liquid ejecting apparatus in which the waiting time is even comparatively short in a case in which liquid ejection is interrupted after liquid ejection that receives a selection to perform liquid ejection by a user instructing to eject liquid has been initiated.

Hereinafter, means of the invention and operation effects thereof will be described.

According to an aspect of the present invention, there is provided a liquid ejecting method of a liquid ejecting apparatus that ejects a liquid onto a target on the basis of acquired conditions, the method including acquiring a residual amount of liquid that is useable, estimating a use amount of liquid that is used in ejection of liquid using a set use amount of liquid per single target quantity that is set in advance with respect to a size of a target that is included in the acquired conditions, and performing a warning that is related to the residual amount of liquid before ejecting the liquid onto the target that is used in a case in which the residual amount of liquid after liquid ejection, which is estimated on the basis of the residual amount of liquid and the use amount of liquid, is smaller than a threshold value. Additionally, the processes of each step may be performed by a liquid ejecting apparatus, and in a case of a configuration in which a liquid ejecting apparatus performs the ejection of liquid due to an instruction from a host device, the processes of each step may be performed by either the liquid ejecting apparatus or the host device, or the processes of each step may be performed in a divided manner by the liquid ejecting apparatus and the host device.

According to this method, since a numerical value that is set in advance is used as the use amount of liquid that is used in the ejection of liquid, a time that is required to acquire the calculation of the use amount of liquid or the like is short. Therefore, since the required times of the processes of each step are short, a waiting time from when a user gives an instruction to eject liquid onto a target to when ejection of the liquid is initiated is comparatively short in a case in which a warning is unnecessary.

In the abovementioned liquid ejecting method of a liquid ejecting apparatus, it is preferable that the acquiring of the residual amount, the estimating of the use amount, and the performing of the warning be performed in a case in which the size of a target that is included in the acquired conditions is larger than a stipulated size, and the acquiring of the residual amount, the estimating of the use amount, and the performing of the warning not be performed in a case in which the size of a target that is included in the acquired conditions is less than or equal to the stipulated size.

According to this method, in a case in which the size of the target is larger than the stipulated size, and a risk that the residual amount of liquid becomes less than the threshold value in the middle of liquid ejection and liquid depletion is determined, is relatively high, the processes of each step are performed, and a warning that is related to the residual amount of liquid is performed according to necessity. Therefore, it is possible to reduce the frequency at which liquid runs out in the middle of liquid ejection onto the target. Meanwhile, in a case in which the size of the target is smaller than the stipulated size, since the risk that the residual amount of liquid becomes less than the threshold value in the middle of liquid ejection and liquid depletion is determined, is low, the processes of each step are not performed. Accordingly, it is possible to initiate the ejection of liquid quickly after an instruction to eject liquid onto the target is given.

In the abovementioned liquid ejecting method of a liquid ejecting apparatus, it is preferable that a material of the target be included in the acquired conditions, the acquiring of the residual amount, the estimating of the use amount, and the performing of the warning be performed in a case in which the material of the acquired target is a material that belongs to a category with high receiving performance of the liquid, and the acquiring of the residual amount, the estimating of the use amount, and the performing of the warning not be performed in a case in which the material of the acquired target is not a material that belongs to a category with high receiving performance of the liquid.

According to this method, since, in a case in which the target is a material that belongs to a category with high receiving performance of the liquid (for example, specialty paper), it is predicted that the use amount of liquid is high and the risk that the residual amount of liquid will fall below the threshold value in the middle of liquid ejection and liquid depletion will be determined is high, the processes of each step are performed. Meanwhile, since, in a case in which the target is a material that does not belong to a category with high receiving performance of the liquid (for example, normal paper), it is predicted that the use amount of liquid is small, and the risk that liquid depletion will occur in the middle of liquid ejection is low, the processes of each step are not performed. Therefore, since the processes of each step may be performed on a portion, which is a material that belongs to a category with high receiving performance of the liquid, of the target only, it is possible to avoid a circumstance in which a waiting time of the processes of each step is generated before the initiation of liquid ejection in targets other than those mentioned above.

In the abovementioned liquid ejecting method of a liquid ejecting apparatus, it is preferable that input of a selection of whether to perform or cancel liquid ejection be prompted in the warning.

According to this method, when it is determined that the residual amount of liquid has fallen below the threshold value and a warning is given, it is possible to select whether or not to perform or cancel liquid ejection while aware of the risk of liquid depletion. For example, it is possible to select to perform liquid ejection in a case in which there is no spare liquid storage body for exchange.

In the abovementioned liquid ejecting method of a liquid ejecting apparatus, it is preferable that image data be included in the acquired conditions, and the acquired conditions that include the image data be retained until at least received liquid ejection is finished in a case in which a selection to perform liquid ejection is received.

According to this method, even if the residual amount of liquid falls below the threshold value in the middle of liquid ejection and the liquid ejection is interrupted after the liquid ejection that receives a selection to perform liquid ejection by a user instructing to eject liquid has been initiated, since it is possible to use retained conditions that include image data in a case in which liquid ejection is performed again with the same conditions, it is possible to reduce the effort of an operation that reselects the conditions again. Accordingly, even in a case in which liquid ejection is interrupted, the waiting time thereafter is comparatively short.

According to another aspect of the present invention, there is provided a liquid ejecting apparatus that ejects a liquid onto a target on the basis of acquired conditions, the device including a residual liquid amount acquisition unit that acquires a residual amount of liquid that is useable, a use liquid amount estimation unit that estimates a use amount of liquid that is used in ejection of liquid using a set use amount of liquid per single target quantity that is set in advance with respect to a size of a target that is included in the acquired conditions, and a warning unit that performs a warning that is related to the residual amount of liquid before ejecting the liquid onto the target that is used in a case in which the residual amount of liquid after liquid ejection, which is estimated on the basis of the residual amount of liquid and the use amount of liquid, is smaller than a threshold value.

According to this configuration, since a numerical value that is set in advance is used as the use amount of liquid that is used in a liquid ejection action, an acquisition time of the use amount of liquid is completed quickly. Therefore, since a required times of the processes of each step are short, and a waiting time from when a user gives an instruction to eject liquid onto a target to when ejection of the liquid is initiated is comparatively short in a case in which a warning is unnecessary.

BRIEF DESCRIPTION OF THE DRAWINGS

The invention will be described with reference to the accompanying drawings, wherein like numbers reference like elements.

FIG. 10 is a schematic view that shows settings data in a modification example.

FIG. 11 is a schematic view that shows settings data in a modification example that differs from that of FIG. 10.

DESCRIPTION OF EXEMPLARY EMBODIMENTS

First Embodiment

Hereinafter, an embodiment of a liquid ejecting apparatus will be described with reference to the drawings. A liquid ejecting apparatus 11 of the embodiment is a device that prints an image or the like that includes characters, graphics or the like on a paper sheet as one example of a fed target (medium) that has a sheet form by ejecting a liquid that is supplied from a liquid storage body.

Figure 1:
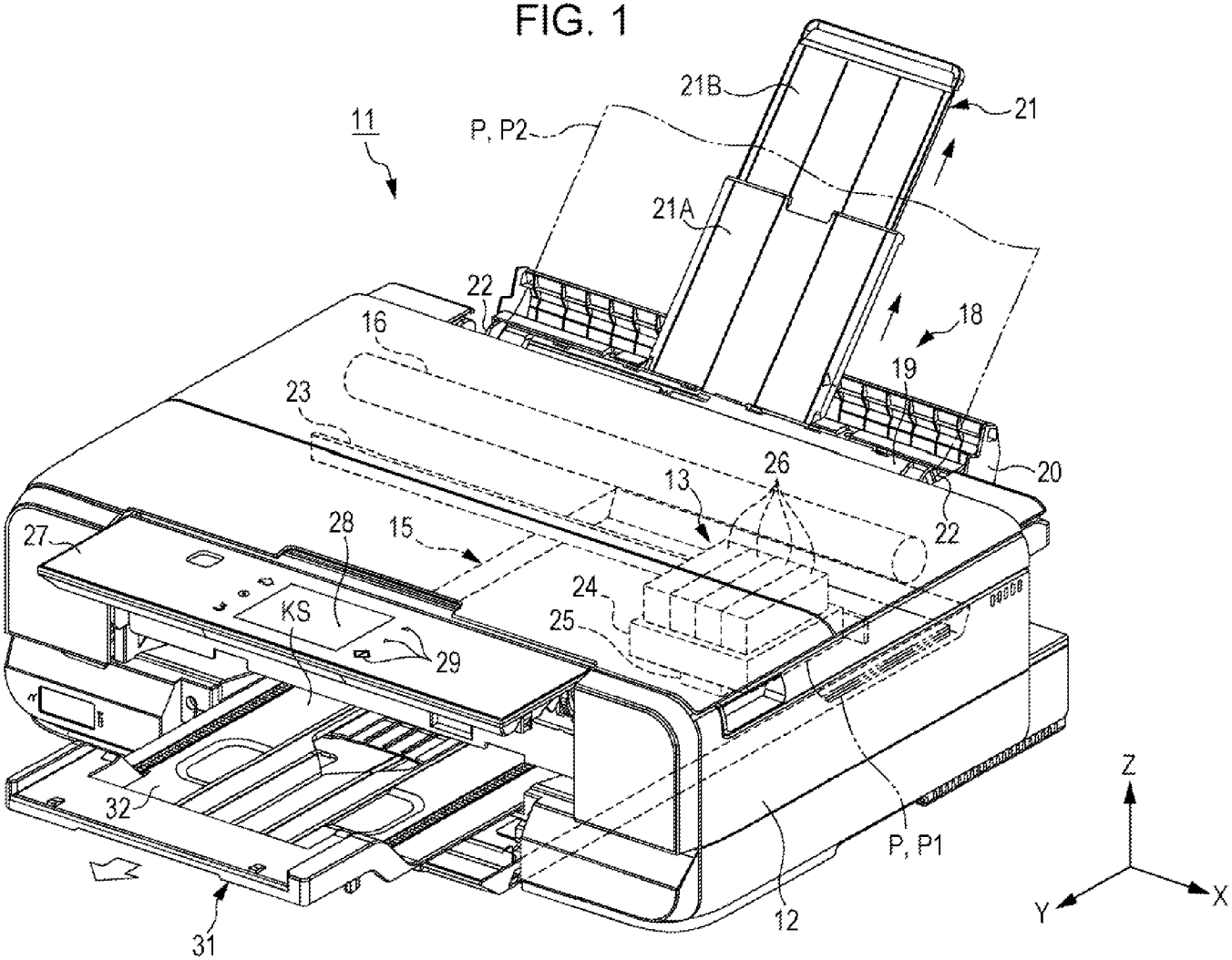
FIG. 1 is a perspective view that shows a liquid ejecting apparatus of a first embodiment.

As shown in FIG. 1, the liquid ejecting apparatus 11 is provided with a recording unit 13, which records an image or the like on a paper sheet P by ejecting ink as one example of a liquid, in an internal part of a device main body 12 that shows a substantially rectangular parallelepiped shape. Furthermore, a feed cassette 15 (feed tray) that is capable of storing a plurality of the paper sheets P in a laminated state is provided in the liquid ejecting apparatus 11 so as to be capable of insertion into the device main body 12. Additionally, the feed cassette 15 is not limited to the one-layered example that is shown in FIG. 1, and a plurality of layers of greater than or equal to two layers may be provided.

The feed cassette 15 is configured so as to be capable of storing one size of paper sheet P, which is selected by a user from among a plurality of types of sizes that are smaller than or equal to a stipulated size (a standard size), in a state in which a plurality of sheets are laminated in a state of being positioned in a width direction. The paper sheets P that are delivered from the feed cassette 15 sheet by sheet in order from the topmost paper sheet P, is supplied to the recording unit 13 by being fed to a downstream side of a transport direction Y using a paper supply roller 16.

A paper sheet P that has a stipulated size or smaller that is capable of being stored in the feed cassette 15 is a size among a plurality of types of sizes of paper sheet that the liquid ejecting apparatus 11 is capable of handling for which the frequency of use is relatively high. In the present example, the stipulated size is A4 size as an example, and the feed cassette 15 can store paper sheets P of each size that is less than or equal to A4 size such as A4 size, B5 size, postcards, 2L size, L size and the like.

As shown in FIG. 1, a manual feed unit 18 that can set a paper sheet P manually sheet by sheet, and that feeds the set paper sheet P to the recording unit 13 is provided on a back surface side of the device main body 12. The manual feed unit 18 is provided with an opening/closing lid 20 that is capable of opening and closing an insertion opening 19 of the paper sheet P. A paper sheet P can be set through manual insertion into the insertion opening 19 that is exposed in an open state of the opening and closing lid 20 that is shown in FIG. 1. Additionally, in the present embodiment, discrimination is made by referring to paper sheets P that are fed from the feed cassette 15 as paper sheets P1 and paper sheets P that are fed from the manual feed unit 18 as paper sheets P2 according to necessity.

The manual feed unit 18 is provided with a support 21 that has a two-layered draw structure that has a support plate 21A that is capable of being drawn out and a support plate 21B that is capable of being drawn out from the support plate 21A and set paper sheets P2 are supported by the support 21. In addition, by adjusting an interval between two moveable members 22 and 22, it is possible to position manually-fed paper sheets P2 in a width direction that intersects a feed direction thereof. It is possible to set paper sheets P2 of a plurality of types of sizes up to a maximum size that is larger than the stipulated size in the manual feed unit 18.

As an example, the maximum size is A3, and it is possible to set paper sheets P2 of each size that is less than or equal to the maximum size such as A3 size, A4 size, B5 size, postcards, 2L size, L size and the like in the manual feed unit 18. Naturally, it is also possible for the stipulated size to be B5 size and the maximum size to be A4 size, or for the stipulated size to be A3 size and the maximum size to be A2 size.

In the liquid ejecting apparatus 11 that is shown in FIG. 1, recording is performed on a paper sheet P that is fed to the recording unit 13 from a side among the feed cassette 15 or the manual feed unit 18 that is selected. In this case, as shown in FIG. 1, the recording unit 13 has a carriage 24 that is guided by a guide frame 23, which is provided in a hanging manner so as to extend along a width direction (this is referred to as a main scanning direction X) that intersects a feed direction of a paper sheet P that is fed into the device main body 12, and is capable of moving in the main scanning direction X.

A liquid ejecting head 25 that has a plurality of rows of nozzles that are capable of ejecting ink, is supported on a lower surface side of the carriage 24. Further, ink is ejected onto a paper sheet P from the liquid ejecting head 25 that moves according to the movement of the carriage 24. Meanwhile, the paper sheet P is moved (intermittent movement) in a transport direction (this is referred to as a sub-scanning direction Y) that intersects the main scanning direction X according to the driving of a transport motor 43 (refer to FIG. 2) with respect to the liquid ejecting head 25. In this manner, in the recording unit 13, the an ink ejection action (a printing action) that draws an image or the like using multiple dots of ink droplets that are impacted upon a paper sheet P, is performed due to an ejection action in which ink droplets are ejected during movement of the carriage 24 in the main scanning direction X and a transport action of the paper sheet P in the sub-scanning direction Y.

As shown in FIG. 1, ink cartridges 26 are mounted to an upper portion of the carriage 24 as an example of a plurality of liquid storage bodies that respectively store inks of differing types, and the inks in the ink cartridges 26 are supplied to the liquid ejecting head 25. Additionally, in the example of FIG. 1, four ink cartridges 26 are installed, but the number of installed ink cartridges 26 may be another number such as five, six or seven. Among the ink cartridges 26, for example, black ink is stored in one or two, and inks of different colors (for example, cyan, magenta and yellow) for color are respectively stored in the remaining three or more. In the present embodiment, in order to simplify the following description, it is assumed that four ink cartridges 26 in which inks of the respective colors of black, cyan, magenta and yellow are stored, are mounted.

Additionally, the ink cartridges 26 are not limited to a so-called on-carriage type of being mounted on the carriage 24, and may be a so-called off-carriage type of being installed on a holder that is fixed in a predetermined position inside the device main body 12. Furthermore, in place of ink cartridges 26, the liquid storage body may be an external type ink tank that is attached to or disposed on an external side of the device main body 12 and is capable of storing a larger amount of ink.

In addition, an operation panel 27 is connected to a front surface side of the device main body 12 in a rotatable state. A display unit 28 (for example, a liquid crystal display) for displaying menu screens and the like, and an operation unit 29 (for example, operation buttons) are provided in the operation panel 27. The operation panel 27 is configured to be rotatable between a closed position that closes a discharge opening KS of paper sheets P and an open position that is shown in FIG. 1 in which the discharge opening KS is exposed.

A substantially rectangular medium receiving unit 31 that receives paper sheets P that are discharged from the recording unit 13 is provided on a front side of the device main body 12 in an extractable state. In an extended state, the medium receiving unit 31 receives paper sheets P that have been discharged through the discharge opening KS after printing on a receiving surface 32 on the upper side thereof. Additionally, the medium receiving unit 31 serves as a guide unit that is capable of guiding a tray, (not shown in the drawings) on which an optical disc, one example of a target (medium), is mounted, into the recording unit 13, and by inserting the tray along the guide unit of the medium receiving unit 31 that is disposed in a stowing position, it is possible to perform printing on a label surface of an optical disc by feeding the optical disc into the recording unit 13.

Figure 2:
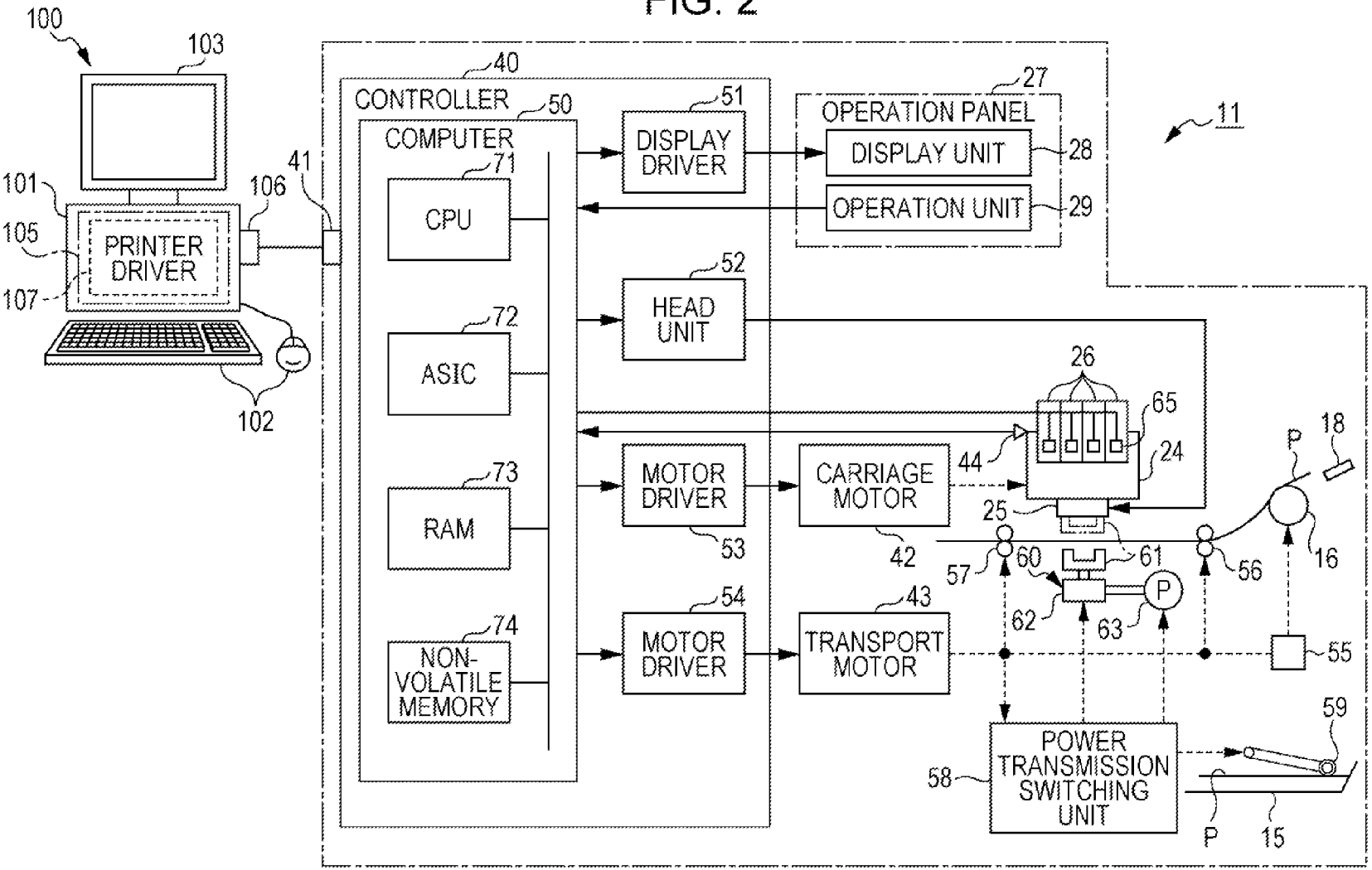
FIG. 2 is a block diagram that shows an electrical configuration of a host device and a printing device.

Next, an electrical configuration of a host device 100 and the liquid ejecting apparatus 11 will be described using FIG. 2. In the liquid ejecting apparatus 11, it is possible for a user to give an instruction to print using the operation unit 29, and it is also possible to give an instruction to print from the host device 100 in a state in which the liquid ejecting apparatus 11 is connected to the host device 100 that is shown in FIG. 2 in either a wired or wireless communicable state.

The host device 100 is provided with a main body 101, an operation unit 102 that is formed from a keyboard and a mouse, and a display unit 103 (monitor). The host device 100 for example, is configured by a personal computer, but may be a mobile terminal such as a smartphone, a mobile telephone, a tablet PC, or a Personal Digital Assistant (PDA).

A computer 105 and a communication unit 106 are provided in the main body 101. The computer 105 is provided with a central processing unit (CPU; not shown in the drawings), ROM, RAM and a hard disk drive. A printer driver 107 that is formed from software that is built by the CPU executing a program is built into the computer 105. In the present embodiment, a printing system is configured by the printer driver 107 and the liquid ejecting apparatus 11.

By operating the operation unit 102, it is possible for a user to select a printing subject (for example, image data) and printing conditions on a settings screen that the printer driver 107 displays on the display unit 103. Medium size (for example, paper sheet size), medium type (for example, paper sheet type), printing color and printing mode (printing quality) are included in the printing conditions. When an order that gives an instruction to print is received, the printer driver 107 carries out image processes that include resolution conversion, color conversion and halftone processing on the image data for example, RGB colorimetric system image data according to the printing conditions, and creates CMYK colorimetric system printing image data. Printing job data PD is created by attaching a portion of the printing conditions to the printing image data as a header, and the printing job data PD is sent to the liquid ejecting apparatus 11. In the present example, at least the paper sheet size and the paper sheet type are included in the header. Additionally, in the present embodiment, the image data and the printing conditions correspond to an example of acquired conditions.

In addition, as shown in FIG. 2, the liquid ejecting apparatus 11 is provided with a controller 40 that manages various controls and a communication unit 41. Wired or wireless communication between the host device 100 and the liquid ejecting apparatus 11 is possible through the communication units 41 and 106. The controller 40 controls the printing action of the liquid ejecting apparatus 11 and the like on the basis of the printing job data PD that is received from the host device 100. Additionally, the notification of ink related information (such as a residual amount of ink and ink run-out) from the liquid ejecting apparatus 11 to the host device 100 is also performed through the communication units 41 and 106.

The display unit 28, the liquid ejecting head 25, a carriage motor 42 that is a power source of the carriage 24, and the transport motor 43 that is a power source that transports a target such as a paper sheet P or an optical disc are connected to the controller 40 as an output system. In addition, the operation unit 29, and ink sensors 44, which individually detect the residual amount of ink inside each ink cartridge 26 becoming less than or equal to a predetermined value in an optical manner, are connected to the controller 40 as an input system.

As shown in FIG. 2, the controller 40 is provided with a computer 50, a display driver 51, a head unit 52 and motor drivers 53 and 54. The computer 50 respectively controls the driving of the liquid ejecting head 25, the carriage motor 42 and the transport motor 43 through the head unit 52 and the drivers 53 and 54 on the basis of printing job data.

The transport motor 43 is capable of forward and reverse rotation, and the power of the forward and reverse rotation is transmitted to the paper supply roller 16 through a unidirectional rotational mechanism 55 as a unidirectional rotation, and then transmitted to a pair of transport rollers 56 and a pair of discharge rollers 57 as either a forward rotation or a reverse rotation depending on a rotational direction of an input. The power of the transport motor 43 is selectively transmitted to a pick-up roller 59 that sends paper sheets P from the feed cassette 15, an elevating mechanism 62 of a cap 61 of a maintenance device 60, and a suction pump 63 through a power transmission switching unit 58 (a clutch unit). In a state in which the carriage 24 pushes a switching lever (not shown in the drawings) that is positioned on a movement pathway of the carriage 24, the power transmission switching unit 58 is switched to a switching position that depends on a rotational position due to the rotation of the transport motor 43. Further, one component among the pick-up roller 59, the elevating mechanism 62 of the maintenance device 60 and the suction pump 63 is selected as a destination for the transmission of power depending on the switching position.

As shown in FIG. 2, a memory element 65 (IC) that is connected in a state in which access from the computer 50 is possible in a state of being mounted to the carriage 24, is provided in each ink cartridge 26. Ink related information that includes an identification number (ID), ink color and ink amount (internal capacity) of the corresponding ink cartridge 26, is stored in the memory element 65.

Figure 7:
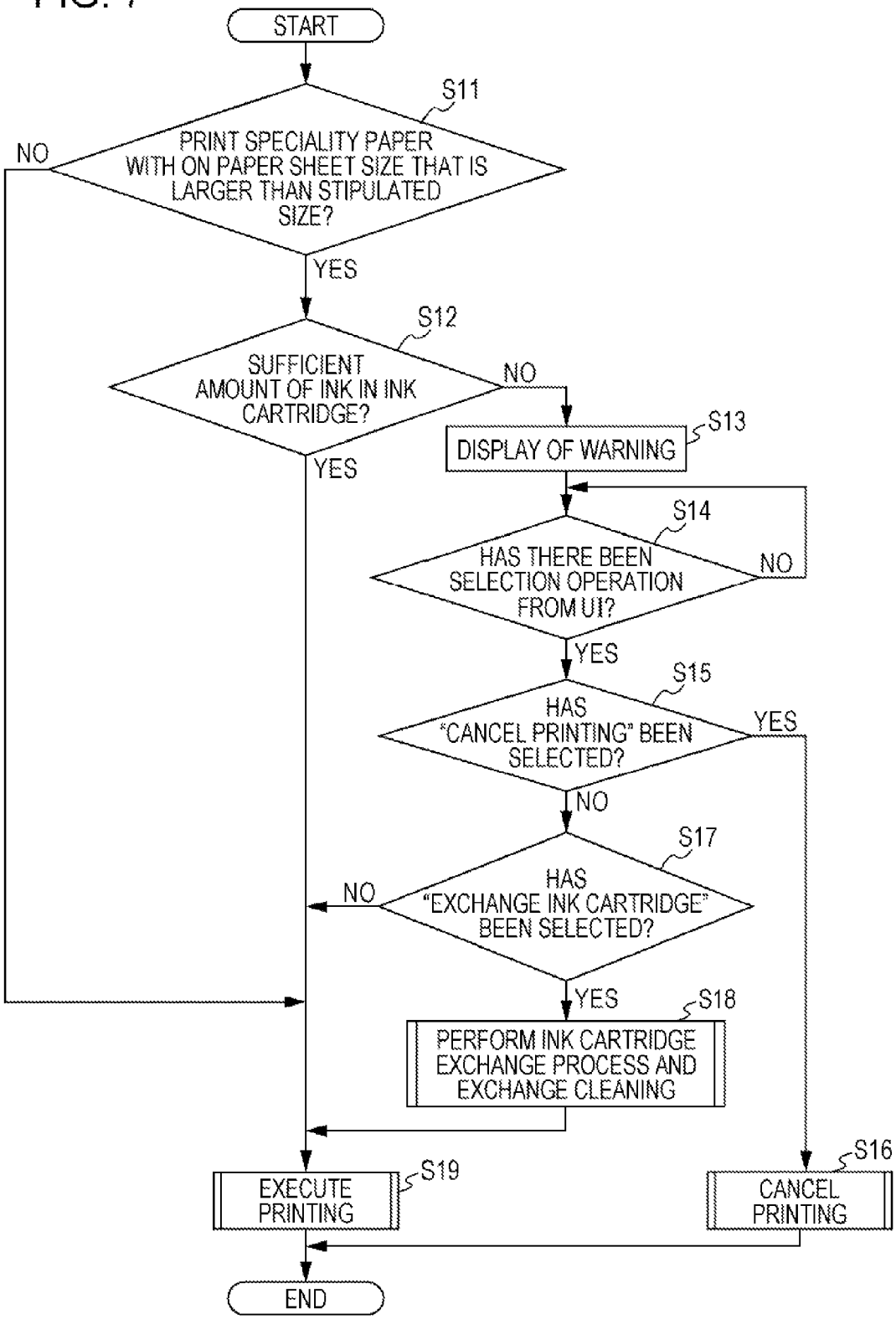
FIG. 7 is a flowchart that shows an ink run-out prediction process.
Figure 8:
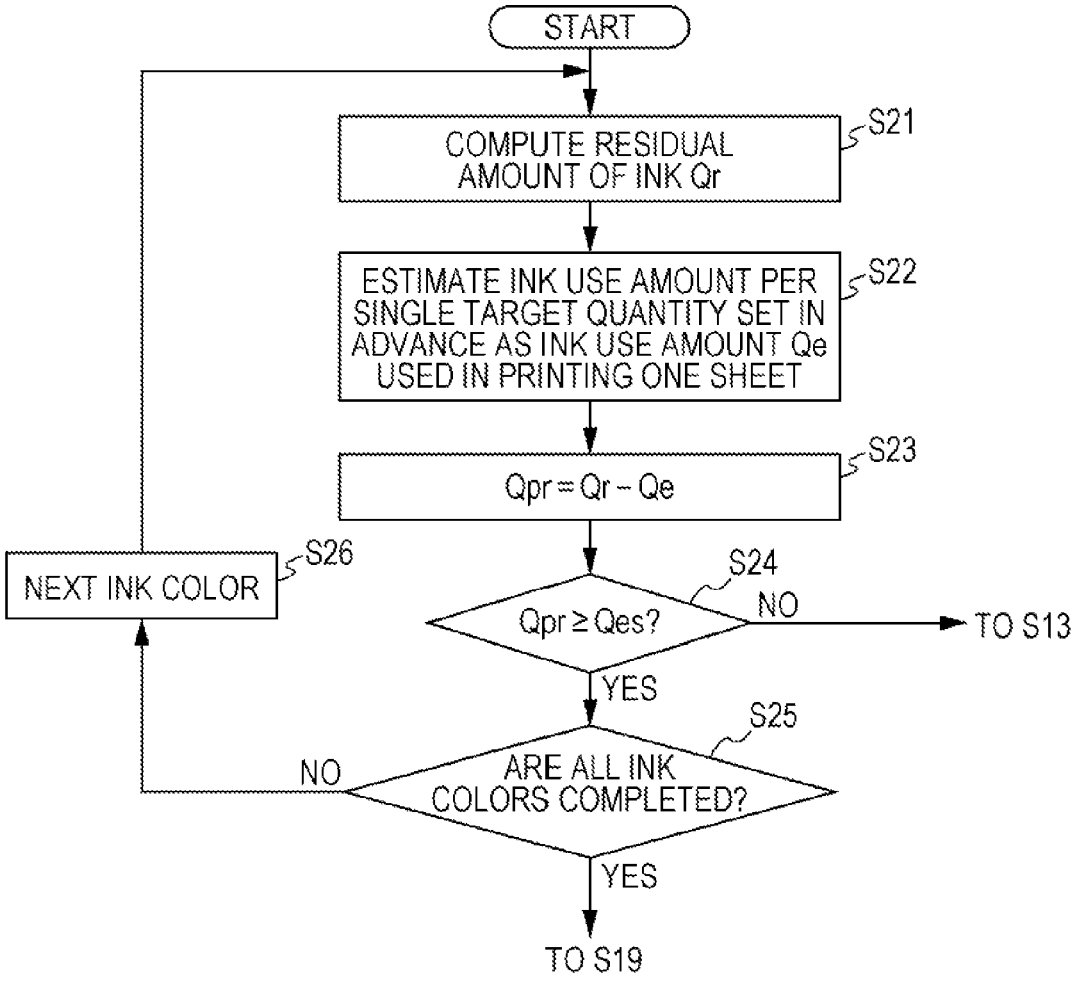
FIG. 8 is a flowchart that shows the processes of a portion of the ink run-out prediction process in detail.

The computer 50 is provided with a CPU 71 (central processing unit), an Application Specific IC 72 (ASIC), RAM 73 and non-volatile memory 74. Various programs that realize the various functions of the liquid ejecting apparatus 11 are stored in the non-volatile memory 74. Programs for the ink run-out prediction processes that are shown in the flowcharts of FIGS. 7 and 8 are included in the programs that are stored in the non-volatile memory 74. The programs for the ink run-out prediction processes are executed from when an instruction to print is received to when printing is initiated, and then, it is determined, on the basis of the residual amount of ink and a required amount of ink, whether or not ink depletion, in which the residual amount of ink falls below a threshold value and printing must be interrupted, will be reached in the middle of printing that is to be initiated. In addition, the same programs for the ink run-out prediction processes are stored in a memory inside the computer 105 of the host device 100.

A user performs various input operations that include the setting of printing conditions using a touch panel function of the operation unit 29 or the display unit 28. After selecting an image, the user sets printing conditions such as medium size (for example, paper sheet size), medium type (for example, paper sheet type), printing color (color/grayscale), and printing mode (printing quality). Examples of the medium size include A4 size which is an example of the stipulated size, the maximum size of A3 size which is an example of a size that is larger than the stipulated size, B5 size, postcards, 2L size and L size. The medium type is an item that specifies the material of the target (medium), and specifies the material by the extent of the receiving performance of ink. Examples of the medium type include photographic paper, glossy paper, photomat paper, normal paper, optical disc and the like. In the present example, photographic paper, glossy paper and photomat paper that are used in photographic printing are treated as specialty paper.

In this case, in the present embodiment, "a material that belongs to a category with high receiving performance of the liquid" indicates specialty paper. Specialty paper is formed by a material that has relatively high receiving performance of ink in comparison with normal paper. Specialty paper is paper on which for example, resin coating has been performed and even when large amounts of ink are placed onto the surface thereof, it is unlikely that phenomena such as undulating cockling will be generated in paper sheets due to expansion during the absorption of ink into paper fibers in the manner of normal paper. Therefore, when specialty paper is selected, there is a high probability that printing conditions for photographic printing that eject large amounts of ink, will be selected.

In addition, examples of the printing mode include a "high quality mode" (for example, "fine") that prioritizes printing quality over printing speed, and a "low quality mode (high speed mode)" (for example, "normal") that prioritizes printing speed over printing quality. In a case in which the "high quality mode" is selected, printing is performed with a high resolution in comparison with the low quality mode, and a use amount of ink per single target quantity is relatively large. In a case in which specialty paper is selected, there is a high probability that photographic printing will be performed, and there is a high probability that the high quality mode will be selected.

A user mounts an external storage medium such as a memory card or USB memory to the liquid ejecting apparatus 11, and gives an instruction to execute printing after selecting an image of a printing subject from images read from the external storage medium and displayed on the display unit 28 and selecting printing conditions through operation of the operation unit 29 or the like. In addition, when giving an instruction to print to the liquid ejecting apparatus 11 from the host device 100, an instruction to execute printing is given after selecting an image of a printing subject and selecting printing conditions through operation of the operation unit 102. In this case, printing job data PD from the host device 100 is sent to the liquid ejecting apparatus 11.

In addition to a function that displays a printing conditions settings screen on the display unit 28, and a function that provides a notification of ink related information such as the residual amount of ink and ink depletion, the liquid ejecting apparatus 11 is provided with a data generation function that converts data of the printing subject (image or document data) into printing job data that matches the printing conditions. Furthermore, the liquid ejecting apparatus 11 is provided with an ink run-out prediction function that performs a warning prior to the execution of printing in a case in which there is a possibility that ink will run out when it is determined whether or not there is a possibility that ink will run out in the middle of printing. Further, at the time of this warning, the liquid ejecting apparatus 11 prompts the user to make a selection from the cancellation of printing, ink cartridge exchange or the continuation of printing.

In addition to a display function of a printing conditions settings screen, and a notification function of ink related information, the printer driver 107 is provided with a data generation function that converts data of the printing subject (image or document data) into printing job data that matches the printing conditions. When an instruction to print is given to the liquid ejecting apparatus 11 from the host device 100, the printer driver 107 performs the same ink run-out prediction processes as the liquid ejecting apparatus 11 side, and performs a warning prior to the execution of printing in a case in which it is determined, using residual amount of ink information that is received from the liquid ejecting apparatus 11, that there is a possibility that ink will run out in the middle of printing. Further, at the time of this warning, the printer driver 107 prompts the user to make a selection from the cancellation of printing, ink cartridge exchange or the continuation of printing.

Figure 3:
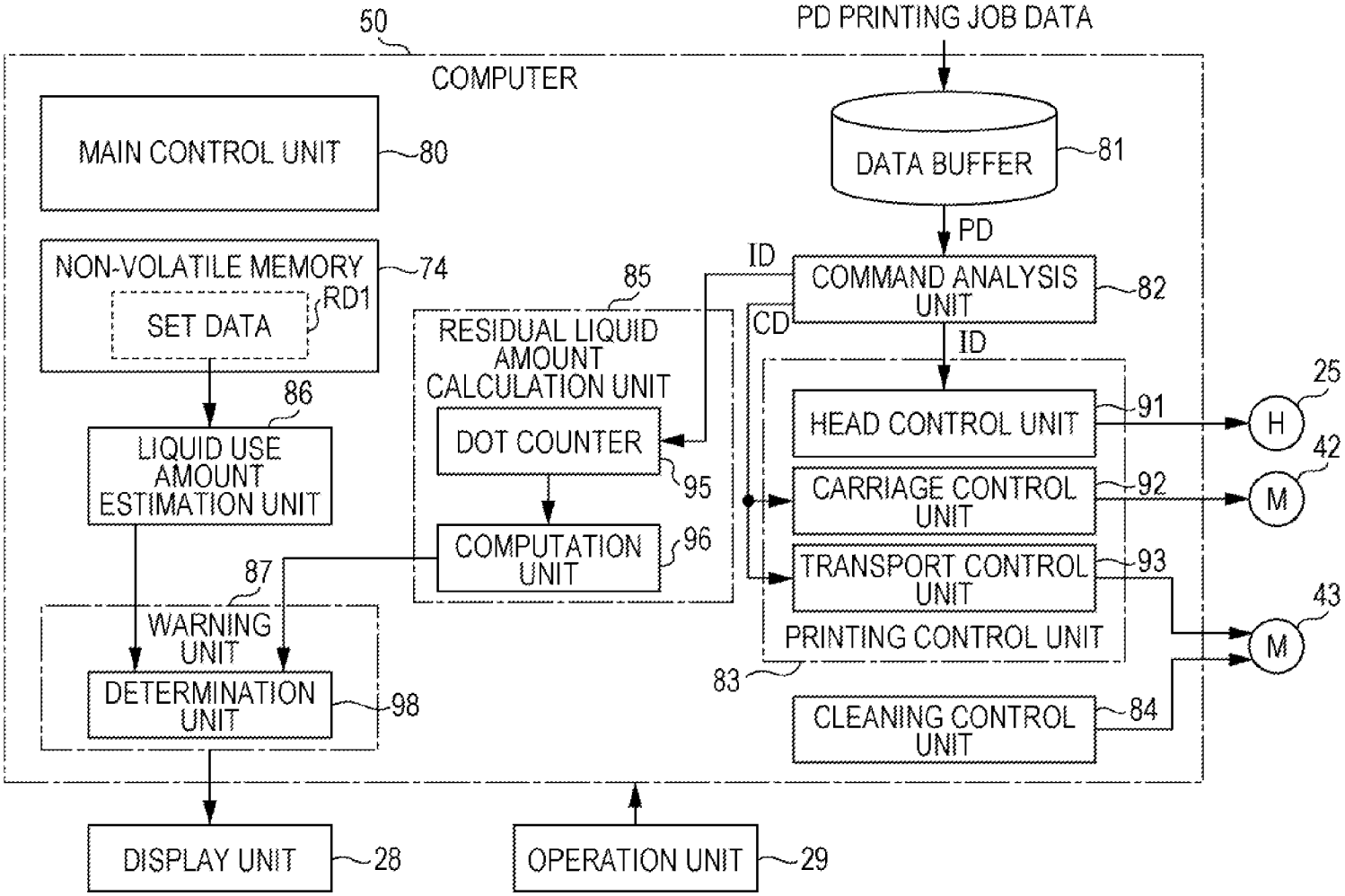
FIG. 3 is a block diagram that shows a functional configuration of a computer inside the liquid ejecting apparatus.

Next, a functional configuration of the computer 50 inside the liquid ejecting apparatus 11 will be described with reference to FIG. 3. The computer 50 that is shown in FIG. 3 has a plurality of functional components that are built by the CPU 71 that executes programs and in the ASIC 72 in which various functional circuits are built. As shown in FIG. 3, as the functional components, a main control unit 80, a data buffer 81, a command analysis unit 82, a printing control unit 83, a cleaning control unit 84, a residual liquid amount calculation unit 85, a liquid use amount estimation unit 86 and a warning unit 87 are provided inside the computer 50. The printing control unit 83 is provided with a head control unit 91, a carriage control unit 92 and a transport control unit 93. In addition, the residual liquid amount calculation unit 85 is provided with a dot counter 95 and a computation unit 96. Furthermore, the warning unit 87 is provided with a determination unit 98. Additionally, in the present embodiment, an example of a residual liquid amount acquisition unit is configured by the residual liquid amount calculation unit 85.

In addition to performing overall control of the various units 81 to 87, the main control unit 80 performs the reception of various input signals and printing condition information from the operation unit 29 or the like, and various determination processes. When the exchange of an ink cartridge 26 that is installed on the carriage 24 is detected, the main control unit 80 acquires ink related information from the memory element 65 of the ink cartridge 26 after exchange, and writes the information of the ink color and ink amount to a predetermined storage region of the non-volatile memory 74.

The data buffer 81 is formed by a storage region of a portion of the RAM 73, and stores printing job data PD that is received from the host device 100.

The command analysis unit 82 splits printing job data PD that is input from the data buffer 81 into command data CD and printing image data ID, and sends each command (order) obtained by interpreting the command data CD among the two types of data to the carriage control unit 92 and the transport control unit 93. The printing image data ID is sent to the head control unit 91 and the dot counter 95.

The head control unit 91 performs driving control of the liquid ejecting head 25 on the basis of the printing image data ID. In addition, the carriage control unit 92 performs driving control of the carriage motor 42 according to commands and performs positional control of the carriage 24 in the main scanning direction X during printing and during maintenance. Furthermore, the transport control unit 93 performs driving control of the transport motor 43 according to commands and controls the feeding and transport of a target such as a paper sheet P during printing.

The cleaning control unit 84 cleans nozzles of the liquid ejecting head 25 by driving the maintenance device 60 during a predetermined cleaning period or when an instruction to clean is received. The cleaning control unit 84 suctions and discharges thickened ink and air bubbles from the nozzles by driving the transport motor 43 while switching the power transmission switching unit 58 as appropriate, capping the liquid ejecting head 25 by raising the cap 61 using the elevating mechanism 62, and setting the space inside the cap 61 that surrounds the nozzles of the liquid ejecting head 25 to a negative pressure by driving the suction pump 63 in this state. In addition, the cleaning control unit 84 performs flushing that refreshes the ink inside the nozzles by moving the carriage 24 to a home position that is shifted in the main scanning direction X from a paper sheet P for every predetermined period of time during printing, and egesting ink droplets that are not related to printing toward the cap 61 from all of the nozzles of the liquid ejecting head 25.

The residual liquid amount calculation unit 85 calculates the residual amount of ink of each ink cartridge 26. The residual liquid amount calculation unit 85 is provided with the dot counter 95 that counts the number of dots on the basis of printing image data ID, and the computation unit 96 that calculates a consumption amount of ink using the values of the dot counter 95 and calculates a residual amount of ink Qr by subtracting the consumption amount of ink from the previous residual amount of ink. For each ink color, the dot counter 95 individually counts the number of dots that corresponds to a consumption amount of ink that has been consumed by the liquid ejecting head 25 on the basis of printing image data ID of each ink color. In a case in which the printing image data ID is for example, two gradations, one dot is represented by one bit of "1" ejection and "0" non-ejection. In a case of for example, four gradations, one dot is represented by two bits of "00" non-ejection, "01" small dot, "10" medium dot and "11" large dot. In a case of greater than or equal to three gradations, since there are a plurality of types of ink amounts per dot, a discrete value per dot is set by multiplying by a coefficient of an ink amount factor (a size factor). In addition, the dot counter 95 counts the number of dots that are egested during flushing and the number of dots that corresponds to a discharge amount of ink during cleaning. In this manner, the dot counter 95 individually counts a value that corresponds to a consumption amount of ink for each ink color.

The computation unit 96 calculates the latest residual amount of ink Qr (the residual amount of ink Qr of this time; =Qr−Qc) by calculating a consumption amount of ink Qc for each ink color on the basis of the individual value of the dot counter 95 for each color at regular intervals or at irregular intervals, and subtracting the consumption amount of ink Qc of this time from the residual amount of ink Qr of the previous time for each ink color. During power shutdown of the liquid ejecting apparatus 11, the residual amount of ink Qr is written to the non-volatile memory 74 or the memory element 65 and stored, and a residual amount of ink Qr that is read from the storage destination is set as the residual amount of ink Qr at the time of turning on the power during subsequent power activation. Additionally, when a detection signal indicating that a residual amount of the ink cartridge 26 has reached ink depletion is input from the ink sensors 44, the residual amount of ink Qr is renewed to a set residual amount of ink of the set detected level of the ink sensors 44.

Figures 4, 5:
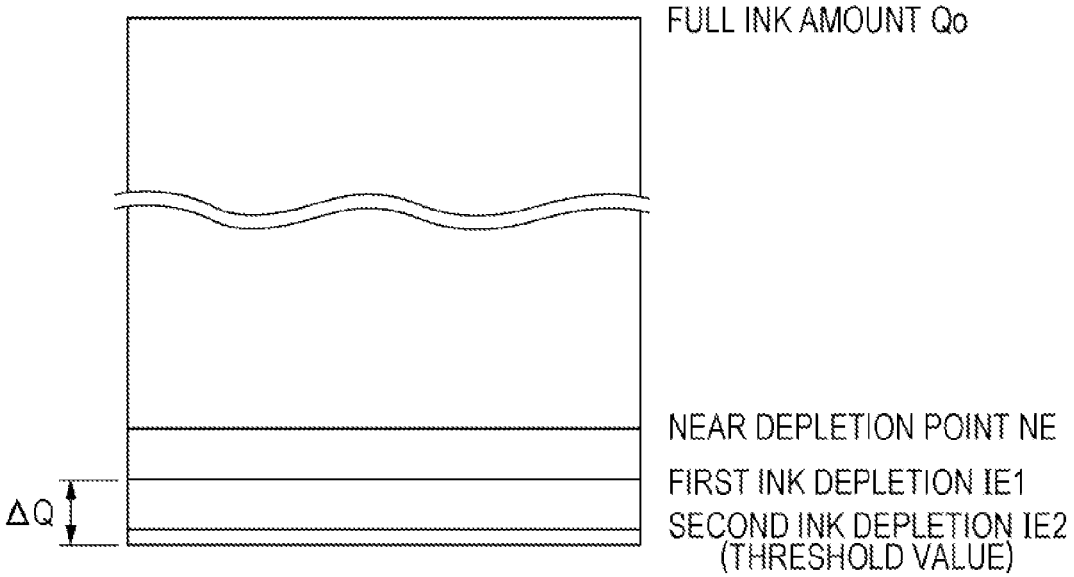
FIG. 4 is a schematic view that shows settings data.
FIG. 5 is a schematic view that shows management contents of a residual amount of ink.

FIG. 5 shows a residual amount of ink that is managed by the computer 50. As shown in FIG. 5, for example, an ink amount at the time of exchanging to a new ink cartridge 26 is a full ink amount Qo that is read from the memory element 65. After mounting of the ink cartridge 26, an ink amount that has been consumed by the ejection of ink droplets during various maintenance and printing is measured and subtracted. Further, when the residual amount of ink passes a near depletion point NE that is set to a level that is close to depletion, and is further decreased by a predetermined amount of ink, a first ink depletion IE1 is reached. The first ink depletion IE1 is a set value at which printing is not performed if the residual amount of ink Qr becomes less than or equal to this level when the liquid ejecting apparatus 11 has received an instruction to print.

Even if the first ink depletion IE1 is reached, there is a surplus amount ΔQ that is capable of printing a small quantity. The surplus amount ΔQ is set to the first ink depletion IE1. The surplus amount ΔQ is an amount with which it is possible to print a single target quantity even if specialty paper of A4 size as an example of the stipulated size is used with printing conditions of the maximum use amount of ink.

The frequency of use of paper sheets that are stored in the feed cassette 15 is high in comparison with paper sheets from the manual feed unit 18. A surplus amount ΔQ that can print until the end (the last pass) of a single sheet even when the residual amount of ink Qr reaches the first ink depletion IE1 in the middle of printing in a case of printing with A4 size, which is the largest size (the stipulated size) among paper sheet sizes with a high frequency of use, and printing conditions of the maximum use amount of ink, is set. In other words, the surplus amount ΔQ is substantially set to an amount that is the sum of the use amount of ink when full header printing that completely covers the entire surface of a target with ink is performed on a sheet of a target, which is of the stipulated size and is specialty paper, in a high quality mode in which the printing resolution is high, and a use amount of ink (flushing use amount) that is used in maintenance during printing of the sheet of the target.

Therefore, if a paper sheet P that is less than or equal to the stipulated size (A4 size) is used, regardless of the printing conditions that are selected, even if the first ink depletion IE1 is reached in the middle of printing, it is possible to completely finish printing of a sheet of the target without ink running out after the first ink depletion IE1 is reached. Therefore, in the present embodiment, ink run-out prediction processes are not performed in a case of printing on a paper sheet P with a paper sheet size that is less than or equal to the stipulated size. In addition, even in a case of a size that is larger than the stipulated size (A3 size in the present example), if printing conditions in which normal paper is selected are used, since it is possible to finish printing of one sheet with the surplus amount ΔQ of ink, ink run-out prediction processes are also not performed in this case. That is, ink run-out prediction processes are only performed in printing on a size that is larger than the stipulated size (A3 size in the present example) and on specialty paper.

When an instruction to print is received, if there is an ink color for which the residual amount of ink Qr is less than or equal to the first ink depletion IE1, in addition to displaying the fact that that color has reached ink depletion and the fact that printing with that color is not possible on the display units 28 and 103, the main control unit 80 that is shown in FIG. 3 prohibits the instructed printing. Meanwhile, if the residual amount of ink Qr is greater than the first ink depletion IE1 when an instruction to print is received, the ink run-out prediction processes that are shown in FIGS. 7 and 8 are performed.

The liquid use amount estimation unit 86 estimates the use amount of ink per one sheet of a target that is to be printed using a use amount of ink (use amount of liquid) per one quantity of target that is set in advance to correspond to the size of a selected target. The liquid use amount estimation unit 86 acquires a use amount of ink (g/sheet) per one paper sheet that is set in advance to correspond to paper sheet size from set data RD1 that is stored in the non-volatile memory 74.

As shown in FIG. 4, a use amount of ink QA3 (g/sheet) per one quantity of target (per one paper sheet) that corresponds to a case of a size that is larger than the stipulated size (A3 size in the present example) and in which the paper sheet type is specialty paper is set in the set data RD1. The use amount of ink QA3 is set to a maximum use amount of ink on the assumption that a sum of the use amount of ink when the high quality mode is selected as the printing mode and full header printing that completely covers the entire surface of a paper sheet is used, and a use amount of ink (flushing use amount) that is used in maintenance (for example, flushing) during printing. By setting the maximum use amount of ink as the set use amount of ink QA3, ink run-out prediction determination is performed safely when printing on a paper sheet with a size that is larger than the stipulated size, and the frequency at which ink runs out in the middle of initiated printing is reduced to an extent of hardly occurring without a warning being displayed.

A residual amount of ink from the residual liquid amount calculation unit 85 and a use amount of ink from the liquid use amount estimation unit 86 are input into the warning unit 87. The warning unit 87 is provided with a determination unit 98 that is capable of determining whether or not a predicted residual amount of ink after liquid ejection Qpr (=Qr−Qe), which is estimated on the basis of the residual amount of ink Qr and a use amount of ink Qe, is smaller than a threshold value Qes. The determination unit 98 determines that printing is possible if the predicted residual amount of ink after printing Qpr, in which the use amount of ink Qe that is estimated by the liquid use amount estimation unit 86 has been taken away from the residual amount of ink Qr before printing, is larger than the threshold value Qes. Meanwhile, in a case in which the determination unit 98 determines that the predicted residual amount of ink after liquid ejection Qpr is less than the threshold value Qes, the warning unit 87 performs a warning that is related to the residual amount of liquid (residual amount of ink) prior to the initiation of the printing that is instructed on this occasion.

Figure 6:
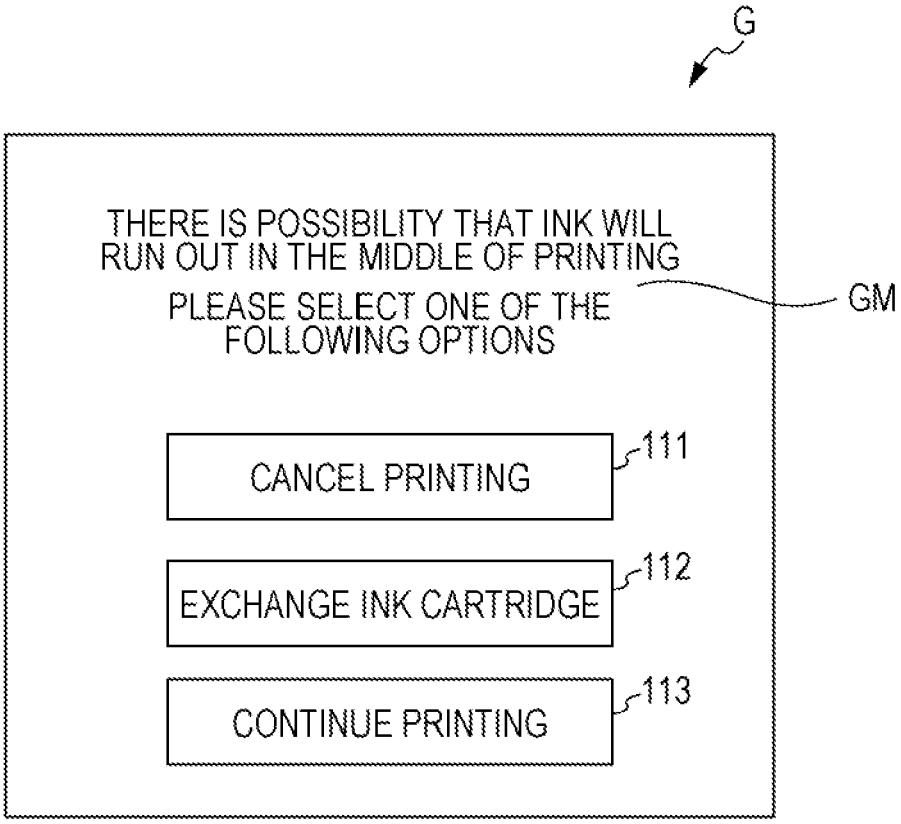
FIG. 6 is a schematic view that shows a warning screen.

In a case in which ink depletion in which the predicted residual amount of ink Qpr falls below the threshold value Qes, is predicted, of the display units 28 and 103, the warning unit 87 displays a warning screen G that is shown in FIG. 6 on the device from which the operation to instruct printing came. As shown in FIG. 6, the message GM that there is a possibility that ink will run out in the middle of printing, and three buttons that are selected by a user, that is, a cancel printing button 111, an ink cartridge exchange button 112 and a continue printing button 113 are provided in the warning screen G. The warning screen G is displayed by the warning unit 87 on the basis of the determination result of the determination unit 98.

In addition, the printer driver 107 includes programs for the same ink run-out prediction processes as those of the liquid ejecting apparatus 11, and the same set data RD1 as FIG. 4 is stored in the memory. A printer driver 107 that has received an instruction to print from the operation unit 102 acquires data of a residual amount of ink Qr using communication with the liquid ejecting apparatus 11, and displays the warning screen G on the display unit 103 in a case in which it is predicted in the ink run-out prediction processes that ink will run out in the middle of printing.

During printing that is initiated by selecting the continue printing button 113, the main control unit 80 determines whether or not an updated residual amount of ink Qr has reached the threshold value Qes every time the carriage 24 completes a printing pass. Further, when the residual amount of ink Qr falls below the threshold value Qes, the main control unit 80 interrupts printing. That is, printing continues without interruption even when the first ink depletion IE1 is reached in the middle of printing, and printing is interrupted at a point in time when the level falls below a second ink depletion IE2. Additionally, at the second ink depletion IE2, a predetermined residual amount of ink ΔQ2 (<ΔQ) that is less than the surplus amount ΔQ remains. The reason for interrupting printing at the time of the residual amount of ink ΔQ2 is to avoid air from entering an ink pathway on the carriage 24 side by continuing a liquid ejection action regardless of the fact that the residual amount of ink is actually empty due to accidental error in the residual amount of ink Qr.

Next, the action of the liquid ejecting apparatus 11 will be described with reference to FIGS. 7 and 8.

A user performs selection of an image of a printing subject and selection of printing conditions by operating the operation unit 29 of the liquid ejecting apparatus 11 or the operation unit 102 of the host device. A default value is set in advance to each item of the printing conditions, and when the user sets a value that differs from the default value, they select a desired value from a selection of the item. Further, the user gives an instruction to the liquid ejecting apparatus 11 to print by operating the operation unit 29 or the operation unit 102. When an instruction to print is received, the computer 50 executes the ink run-out prediction process that is shown in FIG. 7.

In step S11, it is determined whether or not printing on a size that is larger than the stipulated size (A3 size in the present example) and on specialty paper is being performed. In the present example, if printing is on A3 size and specialty paper, the process proceeds to step S12. Meanwhile, if printing is not on A3 size and on specialty paper, the process proceeds to step S19 and printing is executed. For example, in either a case in which printing is on A4 size and on specialty paper, or that of A3 size and on normal paper, the ink run-out prediction process is skipped and printing is initiated.

In step S12, it is determined whether or not there is a sufficient amount of ink in the ink cartridges. This determination is performed by the determination unit 98 using an estimated value of the liquid use amount estimation unit 86. Firstly, the liquid use amount estimation unit 86 estimates a use amount of ink Qe per one quantity of target that depends on the size of the target. That is, the set use amount of ink QA3 per one quantity of target that corresponds to A3 size is set as the use amount of ink Qe by referring to the set data RD that is stored in the non-volatile memory 74 and shown in FIG. 5. Subsequently, the determination unit 98 determines whether or not the predicted residual amount of ink after liquid ejection Qpr that is estimated on the basis of the residual amount of ink Qr and the use amount of ink Qe, is below the threshold value Qes.

Additionally, each time the liquid ejecting head 25 performs a printing pass, the computation unit 96 determines whether or not there is a sufficient amount of ink as appropriate on the basis of a residual amount of ink Qr that is renewed for every pass by calculating the residual amount of ink Qr on the basis of a discrete value of the dot counter 95. If there is a sufficient amount of ink, the process proceeds to step S19 and printing is executed. Meanwhile, if there is not a sufficient amount of ink, the process proceeds to step S13.

In step S13, a warning is displayed. For example, the warning screen G that is shown in FIG. 6 is displayed. The message GM that there is a possibility that ink will run out in the middle of printing, and buttons 111 to 113 that prompt selection of one of the cancellation of printing, ink cartridge exchange and the continuation of printing are included in the warning screen G. A display process of the warning on the display units 28 and 103 is performed by the warning unit 87.

In step S14, it is determined whether or not a selection operation has been made using a user interface (UI). That is, the main control unit 80 determines whether or not there has been an input of an operation signal when one of the buttons 111 to 113 is selected. In a case in which there has been an input of an operation signal, the process proceeds to step S15. Additionally, if there has not been an input in a certain period of time or more, migration to a power saving mode is performed while retaining the selection operation waiting state.

In step S15, it is determined whether or not a selection to cancel printing was made. If a selection to cancel printing was made, the process proceeds to step S16, and if a selection to cancel printing was not made, the process proceeds to step S17.

In step S16, printing is cancelled. In this case, the main control unit 80 erases printing image data and printing conditions data from the RAM 73 (that is, the data buffer 81).

Meanwhile, in step S17, it is determined whether or not a selection to exchange ink cartridges was made. In a case in which a selection to exchange ink cartridges was made, the process proceeds to step S18. In a case in which a selection to exchange ink cartridges was not made, a selection to continue printing was made. In a case in which a selection to continue printing was made, the process proceeds to step S19 and printing is executed.

In step S18, an ink cartridge exchange process and exchange cleaning are performed. A user exchanges an ink cartridge 26. When an ink cartridge is electrically detected, for example, the main control unit 80 reads ink related information from the memory element 65 of the new ink cartridge and stores the information in a predetermined storage region of the RAM 73. As a result of this, the residual amount of ink Qr (a full ink amount Qo if the ink cartridge is new) of the ink cartridge 26 is written to the predetermined storage region of the RAM 73. After ink cartridge exchange, exchange cleaning that discharges air bubbles in the ink pathway, for which there is a concern of mixing during exchange, is performed. In the liquid ejecting apparatus 11, since a transport mechanism that transports paper sheets P and the maintenance device 60 are driven by a common power source (the transport motor 43), supposing ink cartridge exchange is performed in the middle of printing, the transport mechanism is driven during exchange cleaning, a position of a paper sheet P is shifted, and printing fails. However, in the present embodiment, since a warning is displayed prior to the initiation of printing, it is possible to avoid a circumstance in which ink runs out in the middle of printing as much as possible by performing ink cartridge exchange prior to the initiation of printing.

Next, the determination process in step S12 of FIG. 7 of whether or not there is a sufficient amount of ink in an ink cartridge will be described in detail with reference to FIG. 8.

Firstly, in step S21, a residual amount of ink is calculated. The computation unit 96 acquires a current residual amount of ink Qr by subtracting a consumption amount of ink of a first color that is based on a discrete value of the dot counter 95 from a residual amount of ink that corresponds to an ink cartridge of the same color that is stored in the predetermined storage region of the RAM 73. In a case in which the ink colors are for example, the four colors of CMYK, if color printing is being used, of the three colors of CMY, a residual amount of ink is first calculated for a first color (cyan, for example). Additionally, in the present embodiment, the process of step S21 corresponds to an example of a residual amount acquisition step.

In step S22, a use amount of ink per one quantity of target that is set in advance is assumed as the use amount of ink Qe that is used in the printing of one sheet of the target. The liquid use amount estimation unit 86 acquires a use amount of ink QA3 per one quantity of target that is set in advance and corresponds to A3 size, a size that is larger than the stipulated size, and specialty paper by referring to the set data RD1 shown in FIG. 4 that is stored in the non-volatile memory 74, and sets this amount as the use amount of ink Qe. Additionally, in the present embodiment, the process of step S22 corresponds to an example of a use amount estimation step.

In the subsequent step of step S23, a predicted residual amount of ink Qpr after the completion of the printing that is to be performed is worked out using the formula Qpr=Qr−Qe.

In the subsequent step of step S24, it is determined whether or not the predicted residual amount of ink Qpr is greater than or equal to the threshold value Qes (Qpr≥Qes). In a case in which Qpr≥Qes is established and it is determined that printing of a sheet of the target is possible, the process proceeds to step S25, and in a case in which Qpr≥Qes is not established and it is determined that printing of a sheet of the target is not possible, the process proceeds to step S13. Additionally, in the present embodiment, the process of step S23, the process of step S24 and the process of step S13 (FIG. 7) correspond to an example of a warning step.

In step S25, it is determined whether or not the abovementioned processes (S21 to S24) have been completed for all of the ink colors. In a case in which for example, only a portion of the processes of all of the ink colors (for example, those of the first color) have been completed, and the process for all of the ink colors have not been completed, the process proceeds to step S26, and then returns to step S21 after the process subject has been migrated to the next ink color (for example, a second ink color).

Further, the processes of steps S21 to S24 are performed in the same manner on the second color. In a case in which Qpr≥Qes is established in step S24 for the second color and it is determined that printing of a sheet of the target is possible, migration to a third color is performed and the same processes are performed. In this manner, the processes proceed in order for one color at a time, and in a case in which Qpr≥Qes is not established in step S24 of even one color thereof, and it is determined that printing of a sheet of the target is not possible, the process migrates to step S13 and a warning is displayed on the display units 28 and 103 (refer to FIG. 7). Meanwhile, in a case in which Qpr≥Qes is established in step S24 of all of the colors and it is determined that printing of a sheet of the target is possible and a positive determination has been made in step S25 as a result, the process proceeds to step S19 and printing is executed (refer to FIG. 7). That is, the main control unit 80 initiates printing in the printing control unit 83.

At this time, since a numerical value of the use amount of ink QA3 per one sheet of the target that is set in advance is used, in comparison with the configuration of the related art that calculates an use amount of ink on the basis of binary data of concentrated and pale after a halftone process or the sum of gradation values of individual gradation bit image data for each color after color correction processing, it is possible to greatly reduce a required time for acquisition of the use amount of ink. Therefore, the time required by ink run-out prediction processes is greatly reduced, and printing is initiated quickly after a user has given an instruction to print.

During the execution of printing, the main control unit 80 acquires the residual amount of ink Qr every time the carriage 24 makes a pass, and determines whether or not the acquired residual amount of ink Qr is greater than or equal to the threshold value Qes. Since printing is possible if Qpr≥Qes is established, printing continues. Meanwhile, in a case in which Qpr≥Qes is not established in the middle of printing until a final pass is made, printing is interrupted at that point. However, in the present embodiment, even if the first ink depletion IE1 is reached, a residual amount of ink of the surplus amount ΔQ remains, and in addition to it being possible to print on A4 size specialty paper and A3 size normal paper with the surplus amount ΔQ, ink run-out prediction processes are performed prior to the initiation of printing and a warning that there is a possibility that ink will run out is given for printing on A3 size specialty paper for which there is a possibility that printing with the surplus amount ΔQ of ink is not possible. Therefore, a circumstance in which ink runs out (Qr<Qes) in the middle of printing without warning and printing is interrupted hardly occurs. In addition, in printing on A4 size specialty paper and A3 size normal paper, the ink run-out prediction processes (the processes from S12 onwards) are skipped and printing is executed (S19). Therefore, it is possible to initiate printing quickly after a user has given an instruction to print.

According to the present embodiment that has been described in detail above, it is possible to obtain the following effects.

(1) The residual amount of ink Qr is calculated by the dot counter 95 inside the residual liquid amount calculation unit 85 and the computation unit 96, and the use amount of ink QA3 per one sheet of the target that is set in advance to correspond to a selected paper sheet size is estimated as the use amount of ink Qe by the liquid use amount estimation unit 86. In a case in which the predicted residual amount of ink after liquid ejection Qpr, which is estimated on the basis of the residual amount of ink Qr and the use amount of ink Qe, is less than the threshold value Qes, a warning that is related to the residual amount of ink is given by the warning unit 87 prior to the ejection of ink onto a paper sheet P to be used. Accordingly, since a numerical value QA3 that is set in advance is used as the use amount of ink Qe that is used in a printing action, a calculation time of the use amount of ink Qe is short. Therefore, in a case in which a warning is not necessary, the waiting time for ink run-out prediction processes is short, and it is possible to initiate a printing action comparatively quickly in comparison with when ink run-out prediction processes are performed after a user has given an instruction to print.

(2) Since the set use amount of ink QA3 is set as the maximum use amount of ink, it is possible to reduce the frequency at which ink runs out in the middle of printing. In particular, since a maximum use amount of ink includes a use amount of ink in a case of full header printing in a high quality mode that prioritizes image quality and a use amount of ink of maintenance during printing (flushing amount), it is possible to further reduce the frequency with which ink runs out without warning.

(3) Since ink run-out prediction processes are only implemented in a case in which the size of the target is larger than the stipulated size, it is possible to restrict delays in the printing initiation time due to the implementation of ink run-out prediction processes to a necessary minimum extent. In other words, since ink run-out prediction processes are omitted in a case of printing on a paper sheet that is less than or equal to the stipulated size for which there is no concern of ink running out, it is possible to initiate printing quickly after an instruction to print has been given. Accordingly, a contribution to an improvement in the printing throughput is made.

(4) Even in a case of a size that is larger than the stipulated size (for example, the maximum size of A3 size), ink run-out prediction processes are only performed when the material of the target is specialty paper, an example of a material that belongs to a category with high receiving performance of the ink. That is, since ink run-out prediction processes are omitted in a case in which a material that does not belong to a category with high receiving performance of the ink (for example, normal paper) even if the size of the target is larger than the stipulated size, it is possible to further increase the frequency with which printing is initiated quickly after an instruction to print is given. In addition, since ink run-out prediction processes are only performed for specialty paper, it is possible to avoid printing failure with the comparatively costly specialty paper.

(5) Apart from a size of the target that can be accommodated in the feed cassette 15 and for which the frequency of use is relatively high, ink run-out prediction processes are only implemented for a size of the target that can be set in the manual feed unit 18 and for which the frequency of use is relatively low. Accordingly, in addition to it being possible to reduce the frequency of generation of warnings by reducing the frequency of implementation of the ink run-out prediction processes, it is possible to further increase the frequency with which printing is initiated quickly after an instruction to print is given.

(6) At the time of a warning, since a user can select from the cancellation of printing, ink cartridge exchange and the continuance of printing, it is possible to perform selection according to the users preference at that particular time. In particular, since the continuation of printing is an option at the time of a warning, it is possible to print even in a case in which there is no spare ink cartridge. In addition, since the cancellation of printing is an option at the time of a warning, it is possible to reliably avoid printing failure by selecting the cancellation of printing in a case in which there is no spare ink cartridge 26. Furthermore, since ink cartridge exchange is an option at the time of a warning, it is possible to reliably perform printing after the exchange of an ink cartridge 26 without failure.

Second Embodiment

Next, a second embodiment will be described with reference to FIGS. 2, 3, 9 etc. The present embodiment is characterized by the processes of a case in which a user selects the continuation of printing when a warning is displayed.

When an instruction that the continuation of printing selected on the warning screen G of FIG. 6 is received, the printing image data and the printing conditions data is retained in the predetermined storage region (for example, the data buffer 81) of the RAM 73 until at least the received printing is completed. Incidentally, at a time of the generation of a paper jamming error, printing has not been finished, and therefore printing image data and printing conditions data are stored in the RAM 73 since it is prior to the discarding thereof. In contrast to this, at the time of the interruption of printing due to ink running out, since printing up until that point has been completed, used data is discarded. In addition, in the liquid ejecting apparatus 11, the transport mechanism and maintenance device 60 of which are driven by a common power source, the transport motor 43 is driven during implementation of cleaning after ink cartridge exchange, a position of a paper sheet P is shifted, and it is difficult to return the paper sheet P to a position at which the printing can be continued. Therefore, printing is performed on a subsequent paper sheet P, but since a paper sheet is wasted in a case of continuing interrupted printing, in the present embodiment, reprinting that starts the printing from the beginning on the next paper sheet P is performed using the printing image data and printing conditions data that is retained in the RAM 73. The instruction for reprinting is completed easily since at least a portion of the operations among the selection of an image and the selection of printing conditions is omitted.

Figure 9:
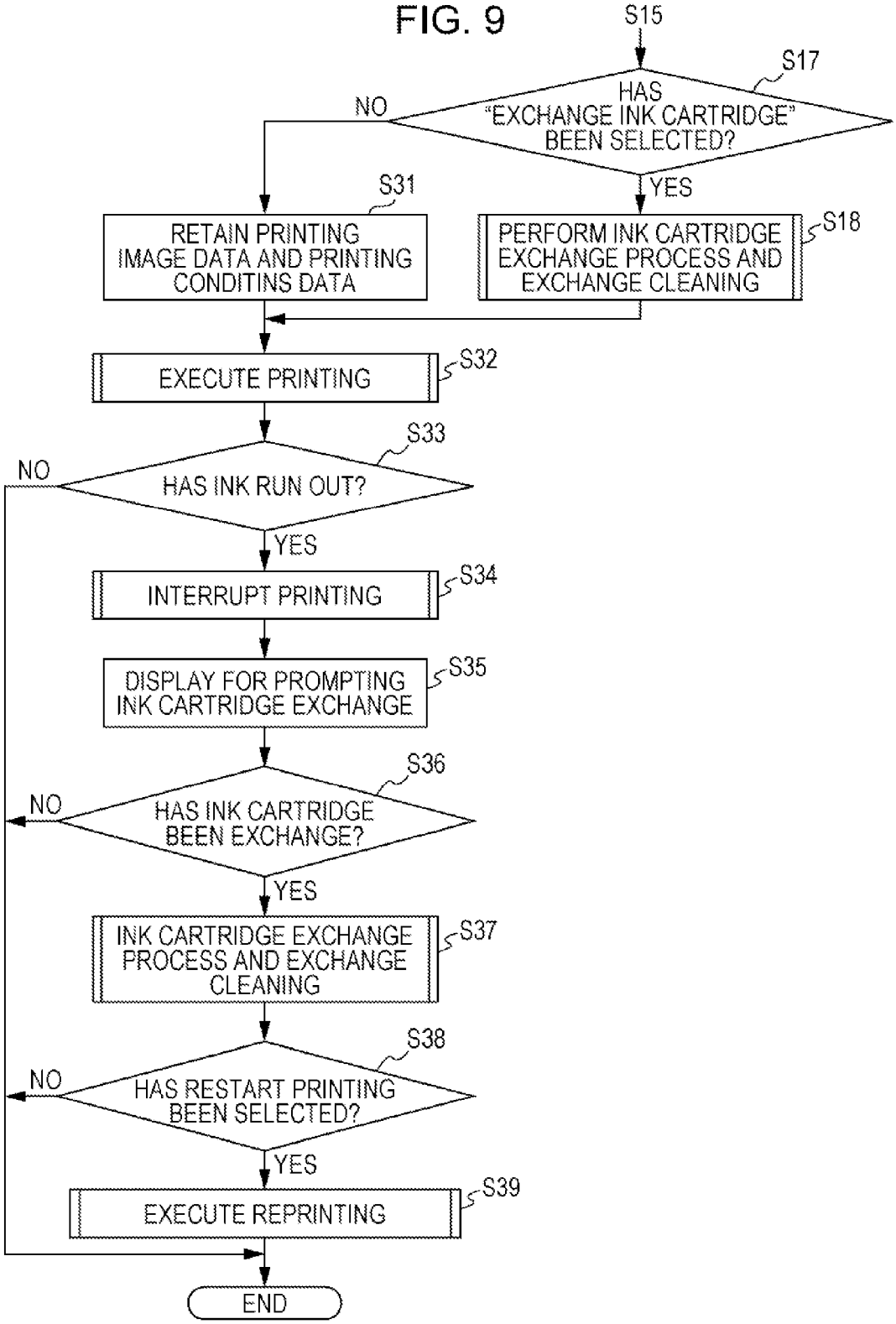
FIG. 9 is a flowchart that shows a process during the continuation of printing in a second embodiment.

Hereinafter, the processes in a case of receiving a selection of the continuation of printing will be described with reference to the flowchart that is shown in FIG. 9.

In step S17, in a case in which ink cartridge exchange is not selected, that is, a case in which the continuation of printing is selected, the process proceeds to step S31.

In step S31, the printing image data and the printing conditions data are retained. For example, the main control unit 80 retains the printing job data PD in a storage region by controlling the data buffer 81. In this case, in the first embodiment, the printing job data PD is removed as a result of being sent to the command analysis unit 82, but in the second embodiment, the storage region of data buffer 81 is increased by an amount that is capable of retaining one sheet of printing image data and printing conditions data. For example, in a case in which one sheet of data is sent once, that one sheet of data is stored separately in the storage region. Meanwhile, in a case in which data is sent intermittently through splitting into a plurality of times and sending a portion (for example, an amount for one pass) at a time, the portions are accumulated a plurality of times and data for one sheet is stored in the storage region. In the case of the latter, the retention process also continues during printing. In this manner, printing job data PD that is input into the data buffer 81 is retained in a storage region separately from data that is sent to the command analysis unit 82. Additionally, the printing image data ID after command analysis and the printing conditions data may also be retained in a predetermined storage region of the RAM 73.

Further, in the subsequent step of step S32, printing is executed. In this printing, the main control unit 80 acquires the residual amount of ink Qr every time the carriage 24 makes a pass, and determines whether or not the acquired residual amount of ink Qr is greater than or equal to the threshold value Qes. If Qr≥Qes is established, printing continues. Meanwhile, ink runs out in a case in which Qr≥Qes is not established.

In step S33, it is determined whether or not ink has run out. In a case of ink running out (Qr<Qes), the process proceeds to step S34 and printing is interrupted. Meanwhile, in a case in which printing is finished without ink running out, the routine is finished.

In a case in which printing is interrupted, a display that prompts ink cartridge exchange is shown in the subsequent step of step S35. The main control unit 80 electronically detects ink cartridge exchange by a user.

In step S36, it is determined whether or not ink cartridge exchange has been performed. In a case in which ink cartridge exchange has been detected, the process proceeds to step S37, the routine finishes in a case in which ink cartridge exchange is not detected after a certain period of time has passed or a cancel operation signal is input by a user.

In step S37, an ink cartridge exchange process and exchange cleaning are performed. These processes are the same as those of step S18 (FIG. 7) in the first embodiment.

In step S38, it is determined whether or not reprinting has been selected. For example, after detecting ink cartridge exchange, the main control unit 80 displays a query screen (not shown in the drawings) that asks a user whether or not to reprint on the display units 28 and 103. The query screen includes a reprint button that gives an instruction to reprint and a cancel button that does not give an instruction to reprint, and the main control unit 80 determines which button has been selected from an input operation signal. In a case in which cancel is selected, the routine ends, and in a case in which reprint is selected, the process proceeds to step S39.

In step S39, reprinting is executed. In this case, the main control unit 80 that has received an instruction to reprint reads printing image data and printing conditions data from the storage region of the data buffer 81, and reinputs the various data to the data buffer 81 in order. In this manner, in addition to orders (commands) that are interpreted by the command analysis unit 82 being sent to the carriage control unit 92 and the transport control unit 93, the printing image data ID is sent to the head control unit 91 in order a portion at a time. The liquid ejecting head 25 and each motor 42 and 43 is controlled by the printing control unit 83, and reprinting that starts printing of an interrupted image afresh is performed.

According to the present embodiment, it is possible to further obtain the following effects in addition to those if the first embodiment.

(7) When a selection of the continue printing button 113 is received, the printing image data and the printing conditions data are retained in a predetermined storage region of the RAM 73. Therefore, even if a case in which printing that has been initiated is interrupted due to ink running out is assumed, by using the data that is retained in the RAM 73 at the time of reprinting after ink cartridge exchange, it is sufficient to operate the reprint button only and the operations of selecting an image and printing conditions can be spared.

Additionally, the following modifications are possible in the abovementioned embodiments.

The printing mode in the determination process of step S11 in the first embodiment may be used as a determination condition. For example, in step S11, it is determined whether or not printing on a size that is larger than the stipulated size, on specialty paper and a high quality mode is being performed. Further, in the process of step S12, it is determined whether or not ink will run out using the use amount of ink QA3 per one quantity of target that corresponds to on the size of the maximum size (and specialty paper and the high quality mode) by referring to set data RD2 that is shown in FIG. 10 and which is stored in the non-volatile memory 74. The liquid use amount estimation unit 86 acquires the use amount of ink QA3 per one target among the set data RD2 that corresponds to the maximum size (A3 size).

As shown in FIG. 11, all sizes of target may use set data RD3 in which the use amount of ink per one quantity of target is set in advance for each of plurality of types of material (medium type). In the example of FIG. 11, use amounts of ink per one quantity of target (an example of a use amount of liquid) are set individually for the two types of material of the specialty paper and normal paper for each paper sheet size such as A3 size, A4 size, . . . , and postcard. The use amounts of ink per one quantity of target are respectively set as QA3S for specialty paper and QA3N for normal paper for A3 size, and QA4S for specialty paper, QA4N for normal paper for A4 size, and QHS for specialty paper and QHN for normal paper for postcard size. In addition to this, use amounts of ink per one sheet are also set for B5 size, 2L size, L size and the like. According to this configuration, since use amounts of ink per one quantity of target that corresponds to the size of the target and the material thereof are set in advance, it is even possible to perform a suitable warning that corresponds to the size of the target and the material thereof in a case in which the surplus amount ΔQ is low and there is a probability that ink will run out (Qpr<Qes) in the middle of printing.

The second ink depletion IE2 may be removed, the residual amount of ink at the time when the first ink depletion IE1 is set as the threshold value Qes, and a warning may be performed when the predicted residual amount of ink Qpr in step S12 falls below the threshold value Qes (S13).

In step S11 (FIG. 7), the material of the target (medium type) may be removed from the determination conditions for determining whether or not to perform the ink run-out prediction processes, and the determination may be performed with the determination condition of whether or not the size of the target is larger than the stipulated size only. In addition, the determination may also be performed with the two determination conditions of whether or not the size of the target is larger than the stipulated size and whether or not it is the high quality mode. The determination may also be performed with the two determination conditions of whether or not the size of the target is larger than the stipulated size and whether or not edgeless printing that also ejects ink droplets onto a protruding region on the outside of the paper sheet is set. In summary, the determination conditions may include whether or not the size of the target is larger than the stipulated size (a size condition) and at least one printing condition among printing conditions for which the probability that photographic printing will be performed, is high.

The set use amount of ink is not limited to the maximum use amount of ink. For example, the set use amount of ink may be a value that does not include the use amount of ink that is used in maintenance during printing. In addition, the set use amount of ink may be a value of a predetermined ratio (for example, a predetermined value within a range of 50 to 90%) with respect to the use amount of ink during full header printing in a high quality mode (high printing resolution). Since full header printing in a high quality mode with a single ink color is not possible, it is possible to display a suitable warning in the majority of printing in which a plurality of colors are used, and it is possible to substantially prevent a circumstance in which printing is interrupted by ink running out without there having been a warning.

Ink run-out prediction processes may only be performed in a case in which the residual amount of ink is less than or equal to a certain amount (for example, a near depletion point NE). According to this configuration, it is possible to initiate printing rapidly after an instruction to print and unnecessary ink run-out prediction processes are omitted until the residual amount of ink decreases to less than or equal to a certain amount.

The stipulated size is not limited to the maximum size of the target that can be accommodated in the feed cassette 15. A size that is smaller than the maximum size may be used, a size that is larger than this maximum size but smaller than the maximum size that can be set in the manual feed unit 18 (for example, B4 size) may also be used.

In step S11 in FIG. 7, it may be determined whether or not the source of the feeding of a target is the manual feed unit 18, and a method that performs ink run-out prediction processes (S12 onward) in a case of the manual feed unit 18 for which there is a probability that the size of the target is larger than the stipulated size, may be used.

A sensor that is capable of detecting the size of a target may be provided in a feed unit, and a method in which it is determined whether or not the size of a target, which is detected by the sensor that is provided in the feed unit that is a feeding source in step S11 of FIG. 7, is larger than the stipulated size, and ink run-out prediction processes (S12 onward) are performed if the size of the target is larger than the stipulated size, may be used. The acquisition method of the size of the target, one of the acquired conditions, is not limited to a method of acquisition through the selection of printing conditions and acquisition through detection by sensors is possible.

programs for the ink run-out prediction processes may be provided in only one of the liquid ejecting apparatus 11 and the printer driver 107. For example, in a configuration in which these programs are only provided in the liquid ejecting apparatus 11, in a case of also displaying the warning screen G on the display unit 103 on the host device 100 side other than the display unit 28, the information of a warning is sent to the printer driver 107 of the host device 100 and it is sufficient to display the warning screen G on the display unit 103. In addition, in a configuration in which these programs are only provided in the printer driver 107, in a case of also displaying the warning screen G on the display unit 28 on the liquid ejecting apparatus 11 side other than the display unit 103, in addition to acquiring a residual amount of liquid from the liquid ejecting apparatus 11 and performing ink run-out prediction processes, the information of a warning is sent to the liquid ejecting apparatus 11 and it is sufficient to display the warning screen G on the display unit 28.

In the second embodiment, in a liquid ejecting apparatus in which the transport mechanism and the maintenance device 60 are driven by separate power sources, in a case in which printing that is initiated by the continuation of printing being selected is interrupted by ink running out, after ink cartridge exchange may be restarted as a continuation of interrupted printing on the paper sheet on which printing was interrupted. In this case, the retention of printing image data and the like is unnecessary.

The warning is not limited to a display and may be a voice or a sound, or may be an LED light that turns on.

The feed cassette 15 may also be configured to be capable of accommodating the maximum size of paper sheet P. In this case, the manual feed unit 18 may also set to be capable of being set up to the stipulated size. In addition, a liquid ejecting apparatus in which there is not manual feed unit and there is only a feed cassette, and a liquid ejecting apparatus in which the opposite is the case and there is no feed cassette and only a manual feed unit (an automatic feed device) are also possible.

Instead of acquiring the residual amount of liquid by working out using a discrete value of the dot counter 95, sensors that are capable of continuously detecting the residual amount of liquid may be provided separately in each liquid storage body (for example, the ink cartridges 26) and the residual amount of ink of each liquid storage body may be acquired on the basis of the detection signals of each sensor.

The liquid ejecting apparatus is not limited to a serial printer in which a liquid ejecting head moves in a direction that intersects the transport direction of a target, and a line printer in which one or a plurality of liquid ejecting heads are positioned in a direction that intersects the transport direction of the target in state of extending so that the nozzles are positioned across the entire width of the target.

The target is not limited to a paper sheet or an optical disc, and may be a resin film, a composite film of paper and a resin (such as resin impregnated paper and resin coated paper), a composite film of a resin and a metal (a laminated film), fabrics, non-woven fabrics, metallic foils, metallic films, ceramic sheets or the like.

The liquid ejecting apparatus is not limited to a printer (includes multifunctional machines) that ejects ink, and may be a liquid ejecting apparatus that ejects or discharges a liquid other than ink. Liquid states that can be discharged from a liquid ejecting apparatus include granules, tears, and filaments that leave a trail. In addition, the liquid may be a material that is capable of being ejected from the liquid ejecting apparatus. For example, the liquid may include substances for which the physical property is a liquid phase, liquids with high or low viscosities, sols, gel waters, other inorganic solvents, organic solvents, solutions, or fluids such as liquid resins. In addition, the liquid may include not only liquids for which the physical property is a single state, and may include solutions, dispersions and mixtures in solvents in which particles of functional materials that are made from solid objects such as pigments or metal particles. Ink and liquid crystal can be included as representative examples of the liquid. In this case, ink can include general aqueous ink and oil-based ink, and various liquid compositions such as gel ink, hot melt ink and the like. As a specific example of the liquid ejecting apparatus, for example, a liquid ejecting apparatus that ejects a liquid that includes a material such as a pigment in a dispersed or dissolved form, a printing device, a microdispenser, a liquid ejecting apparatus that ejects a transparent resin liquid such as an ultraviolet curable resin for forming lens layers such as a microlens on a target and the like can be included. The target may be a circuit board or the like.

The entire disclosure of Japanese Patent Application No. 2013-170418, filed Aug. 20, 2013 is expressly incorporated by reference herein.

What is claimed is:

1. A liquid ejecting method of a liquid ejecting apparatus that ejects a liquid onto a target on the basis of acquired conditions, the method comprising:

acquiring a residual amount of liquid that is useable;

estimating a use amount of liquid that is to be used in ejection of liquid, the use amount of liquid being a set use amount of liquid per single target quantity that is set in advance with respect to a size of a target that is included in the acquired conditions, the set use amount of liquid being associated with a target having a size that is a maximum size for the liquid ejecting apparatus; and before ejecting the liquid onto the target, performing a warning when the residual amount of liquid after liquid ejection, which is estimated on the basis of the residual amount of liquid and the use amount of liquid, is smaller than a threshold value, wherein the threshold value is with respect to a maximum amount of liquid that is used in ejection of liquid to a stipulated target having a size that is smaller than the maximum size, and wherein the target of the maximum size is transported toward an area where the liquid ejection is performed via a transportation path, the transportation path being different from a transportation path that transports the stipulated target.

2. The liquid ejecting method according to claim 1, wherein the acquiring of the residual amount, the estimating of the use amount, and the performing of the warning are performed in a case in which the size of a target that is included in the acquired conditions is larger than the stipulated size, and the acquiring of the residual amount, the estimating of the use amount, and the performing of the warning are not performed in a case in which the size of the target that is included in the acquired conditions is less than or equal to the stipulated size.

3. The liquid ejecting method according to claim 1, wherein a material of the target is included in the acquired conditions, and wherein the acquiring of the residual amount, the estimating of the use amount, and the performing of the warning are performed in a case in which the material of the acquired target is a material that belongs to a category with high receiving performance of the liquid, and the acquiring of the residual amount, the estimating of the use amount, and the performing of the warning are not performed in a case in which the material of the acquired target is not a material that belongs to a category with high receiving performance of the liquid.

4. The liquid ejecting method according to claim 1, wherein input of a selection of one of a cancellation of liquid ejection, a continuation of liquid ejection and an exchange of a liquid cartridge that accommodates the liquid is prompted in the warning, wherein the acquired conditions that include an image data are retained until at least received liquid ejection is finished in a case in which a selection of one of the continuation of liquid ejection and the exchange of the liquid cartridge is received, wherein the acquired conditions that include the image data are erased in a case in which a selection of the cancellation of liquid ejection is received.

5. The liquid ejecting method according to claim 1, wherein input of a selection of whether to perform or cancel liquid ejection is prompted in the warning.

6. The liquid ejecting method according to claim 5, wherein image data is included in the acquired conditions, and wherein the acquired conditions that include the image data are retained until at least received liquid ejection is finished in a case in which a selection to perform liquid ejection is received.

7. The liquid ejecting method according to claim 1, wherein the threshold value is with respect to a maximum amount of liquid that is used in ejection of liquid to a stipulated target having a size that is smaller than the maximum size.

8. The liquid ejecting method according to claim 7, wherein a frequency of use of the stipulated target is higher than the frequency of use of the target of the maximum size.

9. The liquid ejecting method according to claim 7, wherein the maximum amount of liquid includes a sum of (i) an amount of ink used for a high quality mode is selected as a printing mode, (ii) full header printing that completely covers an entire surface of the target, and (iii) an amount of ink used in maintenance during ejection of the liquid onto the target.

10. A liquid ejecting apparatus that ejects a liquid onto a target on the basis of acquired conditions, the device comprising:

a residual liquid amount acquisition unit that acquires a residual amount of liquid that is useable;

a use liquid amount estimation unit that estimates a use amount of liquid that is used in ejection of liquid, the use amount of the liquid being a set use amount of liquid per single target quantity that is set in advance with respect to a size of a target that is included in the acquired conditions, the set use amount of liquid being associated with a target having a size that is a maximum size for the liquid ejecting apparatus; and a warning unit that performs a warning, before ejecting the liquid onto the target, that the residual amount of liquid after liquid ejection, which is estimated on the basis of the residual amount of liquid and the use amount of liquid, is smaller than a threshold value, wherein the threshold value is with respect to a maximum amount of liquid that is used in ejection of liquid to a stipulated target having a size that is smaller than the maximum size, and wherein the target of the maximum size is transported toward an area where the liquid ejection is performed via a transportation path, the transportation path being different from a transportation path that transports the stipulated target.

11. The liquid ejecting apparatus according to claim 10, further comprising a manual feed unit configured to set the target of the maximum size manually and feed the target toward an area where the liquid ejection is performed.

* * * * *